United States Patent [19]

Usui et al.

[11] 4,109,843

[45] Aug. 29, 1978

[54] WEB FEEDING MECHANISM FOR COMPACT PRINTER

[75] Inventors: Kiyofumi Usui; Shigeyoshi Hirabayashi; Hiroshi Hosogaya, all of Shiojiri, Japan

[73] Assignee: Shinshu Seiki Kabushiki Kaisha, Suwa, Japan

[21] Appl. No.: 784,393

[22] Filed: Apr. 4, 1977

[30] Foreign Application Priority Data

Apr. 2, 1976 [JP] Japan ..... 51-37555

[51] Int. Cl.[2] ..... B65H 17/42

[52] U.S. Cl. ..... 226/109; 226/115

[58] Field of Search ..... 226/50, 108, 109, 110, 226/112, 117, 128, 111, 35, 115

[56] References Cited

U.S. PATENT DOCUMENTS

| | | | |
|---|---|---|---|
| 2,641,470 | 6/1953 | Friedl | 226/110 |
| 2,954,865 | 10/1960 | Hackney | 226/109 X |
| 3,387,758 | 6/1968 | DeLaney | 226/108 |

*Primary Examiner*—Richard A. Schacher

*Attorney, Agent, or Firm*—Blum, Moscovitz, Friedman & Kaplan

[57] ABSTRACT

A web-feeding mechanism for a compact printer which can feed at least one web of paper at selectively variable feeding rates is provided. A pair of rotatably driven web feeding rollers is positioned on a first side of the web of paper to be fed, and cooperates with a pair of selectively displaceable idler rollers correspondingly positioned on the other side of the web. The respective feeding rollers are each capable of being driven at a different rotary speed. The respective idler rollers are selectively displaceable between a first position out of engagement with its associated web feeding roller, at which time web feeding by the feeding roller corresponding thereto is prevented, and a second position in engagement with the paper web and the web feeding roller corresponding thereto for feeding the web therebetween at the feeding rate of the feeding roller.

19 Claims, 5 Drawing Figures

FIG. 4
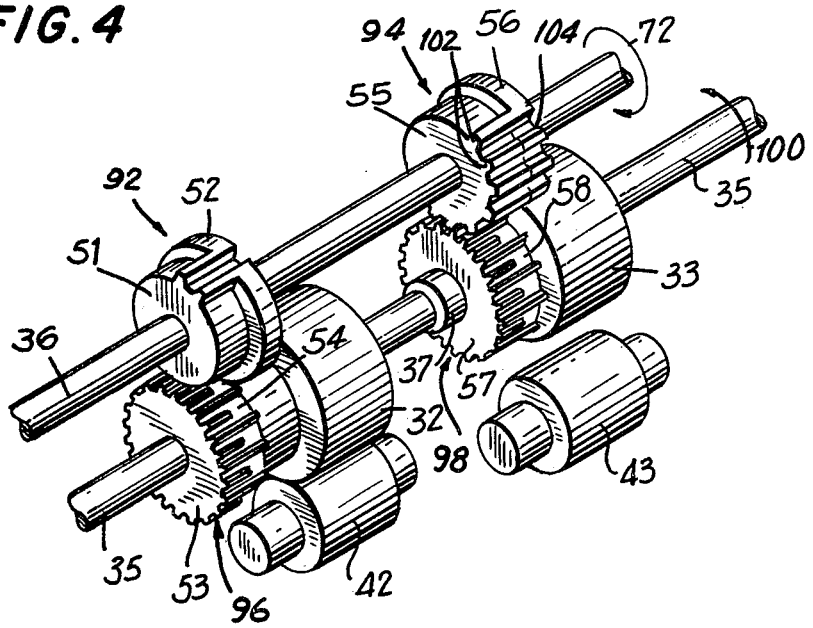
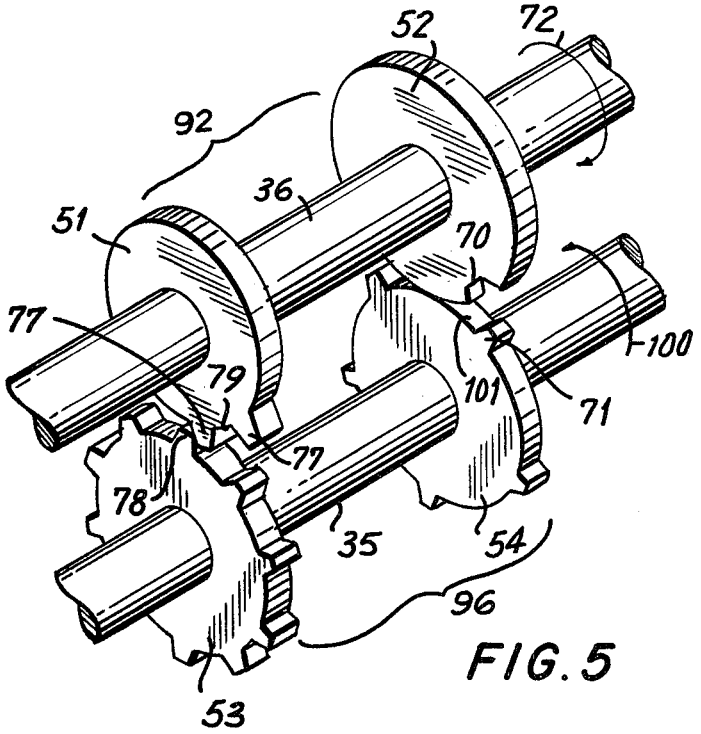
FIG. 5

WEB FEEDING MECHANISM FOR COMPACT PRINTER

BACKGROUND OF THE INVENTION

This invention relates generally to a paper feeding mechanism for a compact flying printer and particularly to a paper feeding mechanism capable of feeding one or more webs of paper, at selectively variable feeding rates. Conventional paper feeding mechanisms, generally feed a web of paper at a feed rate corresponding to one line of type for each printing cycle. If a printing operation requires a paper feed of more than one line of type for each printing cycle, it is necessary to repeat the feeding operation each time one line is typed or printed. Such paper feeding mechanisms are therefore limited to a single paper feeding rate. Although paper feeding mechanisms are available that feed more than one web of paper, these feeding mechanisms are generally less than completely satisfactory since both webs of paper are fed at the same time, even when only one web feed is required. Moreover, both webs of paper are fed at the same rate. When different feed rates and/or a dual paper feed is provided, the feeding mechanisms require multiple drive motors. Accordingly, a paper feeding mechanism capable of feeding at least one web of paper at selectively variable feed rates and/or independently feeding a plurality of webs of paper, utilizing a single drive mechanism, is desired.

SUMMARY OF THE INVENTION

Generally speaking, in accordance with the invention, a web feeding mechanism for a compact flying printer capable of feeding at least one web of paper, at selectively variable feed rates is provided. A pair of rotatably driven paper feed rollers for each web of paper, and a pair of selectively displaceable idler rollers, corresponding to paper feeding rollers, are disposed on opposite sides of a web of paper. Each paper feed roller is capable of being driven at a different rotary speed. The respective idler rollers are selectively displaceable between a first position out of engagement with the corresponding paper feed roller and paper web therebetween, so that paper feeding by the corresponding feed roller is prevented, and a second position in engagement with the paper web and the paper feeding roller corresponding thereto for feeding the paper web in response to the rotation of the feed roller. The idler wheels are disposed to prevent same from both engaging the web at the same time.

Accordingly, it is an object of this invention to provide an improved paper feeding mechanism for a compact printer that is capable of feeding a web of paper at selectively varied feed rates.

Another object of this invention is to provide an improved paper-feeding mechanism for a compact printer which is capable of feeding two webs of paper at selectively varied rates of feed.

A further object of this invention is to provide an improved paper feeding mechanism having single drive motor that is capable of independently or simultaneously feeding two webs of paper at distinct feed rates from a single driving motor.

Still another object of this invention is to provide an improved paper feeding mechanism for a compact printer having a reduced number of components that is easily and economically manufactured, repaired and assembled.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 4 is a partial perspective view of the paper feeding rollers driving and driven gears and associated idler rollers of the web feeding mechanisms depicted in FIG. 1, and FIG. 5 is a perspective view of the first driving and driven gear pairs of the paper feeding mechanisms depicted in FIG. 1 and constructed in accordance with a further preferred embodiment of the instant invention.

DETAILED DESCRIPTION OF THE PREFERRED EMBODIMENTS

Figure 1:
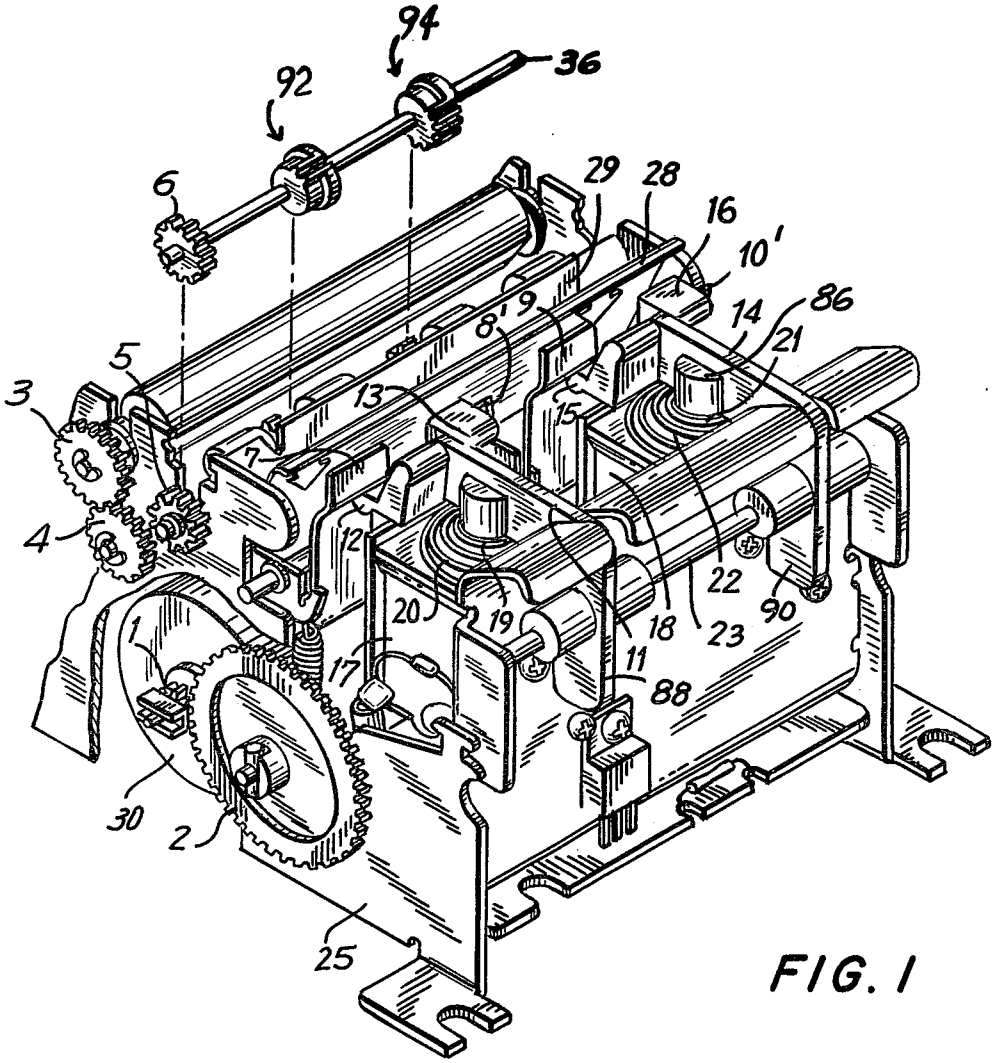
FIG. 1 is a partially exploded perspective view of a web feeding mechanism for a compact printer constructed in accordance with a preferred embodiment of the instant invention.

Turning now to the drawings, a web feeding mechanism which is especially suitable for use with a compact flying printer, is illustrated. The web feeding mechanism is designed to feed one or both of two webs of paper 26, 27 at various speed combinations. Paper feeding is accomplished by displacing webs 26, 27 through paper feeding rollers, which rollers contact the webs 26, 27 on a first side of the web with movable idler rollers contacting the other side of the web, as will hereinafter be more particularly described.

The paper feeding mechanism includes a frame 25, which frame supports a motor 30. A driving gear 1 is driven by motor 30 and is disposed in meshing engagement with a gear 2 rotatably supported by frame 25 to effect a driving of same. Gear 2, through a series of intermediate gears (not shown) rotatably drives gear 3, which gear, in turn, rotatably drives gears 4, 5 and 6. Gears 3, 4, 5 and 6 are arranged so that each gear completes one revolution during a single printing cycle.

Each web of paper 26, 27 enters the mechanism through a pair of paper guides 28, 29, which guides are mounted to frame 25. Web 27 is fed by passing same between a pair of paper feeding rollers 31, 32 on a first side of the web and movable idler rollers 41, 42 disposed on the opposite sides of the web at a position corresponding to rollers 31, 32, respectively. Similarly, web 26 is fed by passing same between paper feeding rollers 33, 34 disposed on a first side of the web, and correspondingly positioned idler rollers 43, 44 disposed on the other side of the web. Each idler roller 41, 42, 43 and 44 is independently rotatably supported on shafts 46, 47, 48 and 49, respectively. Each shaft 46, 47, 48 and 49 is independently mounted for pivotal displacement about shaft 45 on individual support members 7, 8, 9 and 10, respectively. The respective idler rollers 41, 42, 43 and 44 are independently spring biased into engagement with their respective paper feeding rollers by springs 66, 67, 68 and 69, which springs are secured to extensions 61, 62, 63 and 64, respectively, of support members 7, 8, 9 and 10. The other end of springs 66, 67, 68 and 69 are connected to rod 65, which rod is fixably mounted to frame 25.

Figure 2:
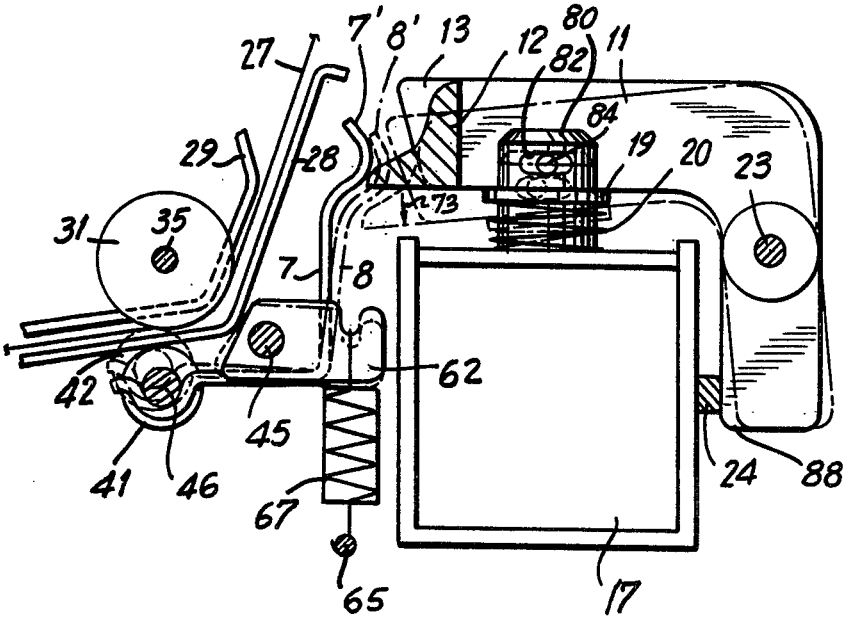
FIG. 2 is a diagrammatic view illustrating the operation of the idler roller selection mechanism of the web feed mechanism depicted in FIG. 1 when the solenoid is in a non-energized position and is in an energized position.

Referring particularly to FIG. 2, each support member 7, 8, 9 and 10 is generally L-configured and includes an upper curved portion 7', 8', 9' and 10', respectively. Solenoids 18, 17 for controlling the feeding of paper webs 26 and 27, respectively, are supported by the frame 25. Solenoid 17 includes a vertically displaceable armature 80 having an elongated slot 82 in which slot is disposed a pin 84, which pin is mounted to idler wheel selection member 11. Armature 80 is normally biased upwardly by spring 20, which spring engages a holder plate 19 disposed in abutting engagement with idler roller selection member 11. Similarly, solenoid 18 (for feeding paper web 26) is provided with an armature 86 coupled to an idler roller selection member 14 through a pin and slot mechanism (not shown), which mechanism is identical to the mechanism described above with respect to solenoid 17. Armature 86 of solenoid 18 is normally biased upwardly by a spring 22 disposed in abutting engagement with a holder plate 21. Idler roller selection members 11 and 14 are each pivotably mounted to shaft 23, which shaft is mounted to frame 25. Each of the idler wheel selection members 11 and 14 are generally L-configured and each free end 88, 90 abuts a pair of dampers 24 mounted to solenoids 17, 18 when the solenoids are in a non-energized state and the idler wheel selection members are normally biased by springs 20 and 22, respectively.

Idler roller selection member 11 is provided with a first projection 12 abutting curved end 7' of idler roller support member 7, and a second projection 13 abutting curved end 8' of idler roller support member 8. First projection 12 of idler wheel selection member 11 is configured to engage the curved end 7' of the idler roller support member 7' at its uppermost position (as shown in solid lines in FIG. 2), so that end 7' of support member 7 will be displaced to the left, as referenced in FIG. 2, to insure that idler roller 41 will be pivotably disposed downwardly about shaft 45 and, hence, maintained out of engagement with paper web 27. Also, when idler roller selection member 11 is normally biased in its uppermost position, second projection 13 will remain out of engagement with portion 8' of support member 8, so that the biasing force of spring 68 will cause support member 8 to be pivoted about shaft 45 and thereby maintain idler roller 42 in engagement with paper web 27.

When solenoid 17 is energized, armature 80 will be downwardly displaced causing projections 12 and 13 of idler roller selection member 11 to be pivotably displaced about shaft 23 in the direction 73, illustrated in FIG. 2. The pivoted displacement of projection 12 will result in same disengaging portion 7' of support member 7 thereby leaving support member 7 free to pivot about shaft 45, under the bias of spring 67, and hence position idler roller 41 in engagement with web 27. Simultaneously, portion 8' of support member 8 is engaged by projection 13, thereby causing support member 8 to pivot about shaft 45 so that idler roller 42 is disengaged from web 27. From the foregoing description, it is apparent that at any given time, only one of idler rollers 41 and 42 will engage web 27. Specifically, when solenoid 17 is not energized, roller 42 is disposed in engagement with web 27 and roller 41 remains out of engagement with web 27. However, when solenoid 17 is energized, roller 42 remains disengaged from web 27 and roller 41 is in engagement with web 27.

The operation of solenoid 18, for controlling the movement of idler roller selection member 14, is in all respects the same as the operation of solenoid 17 and its corresponding idler selection member 11. Idler selection member 14 is provided with a projection 15 for engaging a portion 9' of support member 9 and a projection 16 for engaging a portion 10' of support member 10. When solenoid 18 is not energized, idler roller 44 engages paper web 26 and idler roller 43 remains out of engagement with web 26. Conversely, when solenoid 18 is energized, idler roller 43 is is disposed in engagement with paper web 26 and idler roller 44 is disengaged from web 26. Solenoid 18 therefore controls the selective engagement of paper web 26 by idler roller 43 or 44 in the same manner that solenoid 17 controls which idler roller 41 or 42 is in engagement with paper web 27.

The paper feeding mechanism of the instant invention isalso adapted to selectively vary the rate at which paper webs 26, 27 are fed. Specifically, a pair of paper feeding rollers is provided for each web. Paper feeding rollers 31 and 32 are provided for feeding web 27 and paper feeding rollers 33 and 34 are provided for feeding web 26. The selection of the paper feeding roller, to drive the paper web, is effected by sandwiching the web between the idler roller and the paper feeding roller selected. When the idler roller is disposed in engagement with the web feeding roller, with the web therebetween, the paper web feeding roller effects an advancing or feeding of the paper web. Conversely, when the idler roller does not sandwich the web in engagement with the corresponding paper feeding roller, feeding of the web by that feeding roller is prevented.

Figure 3:
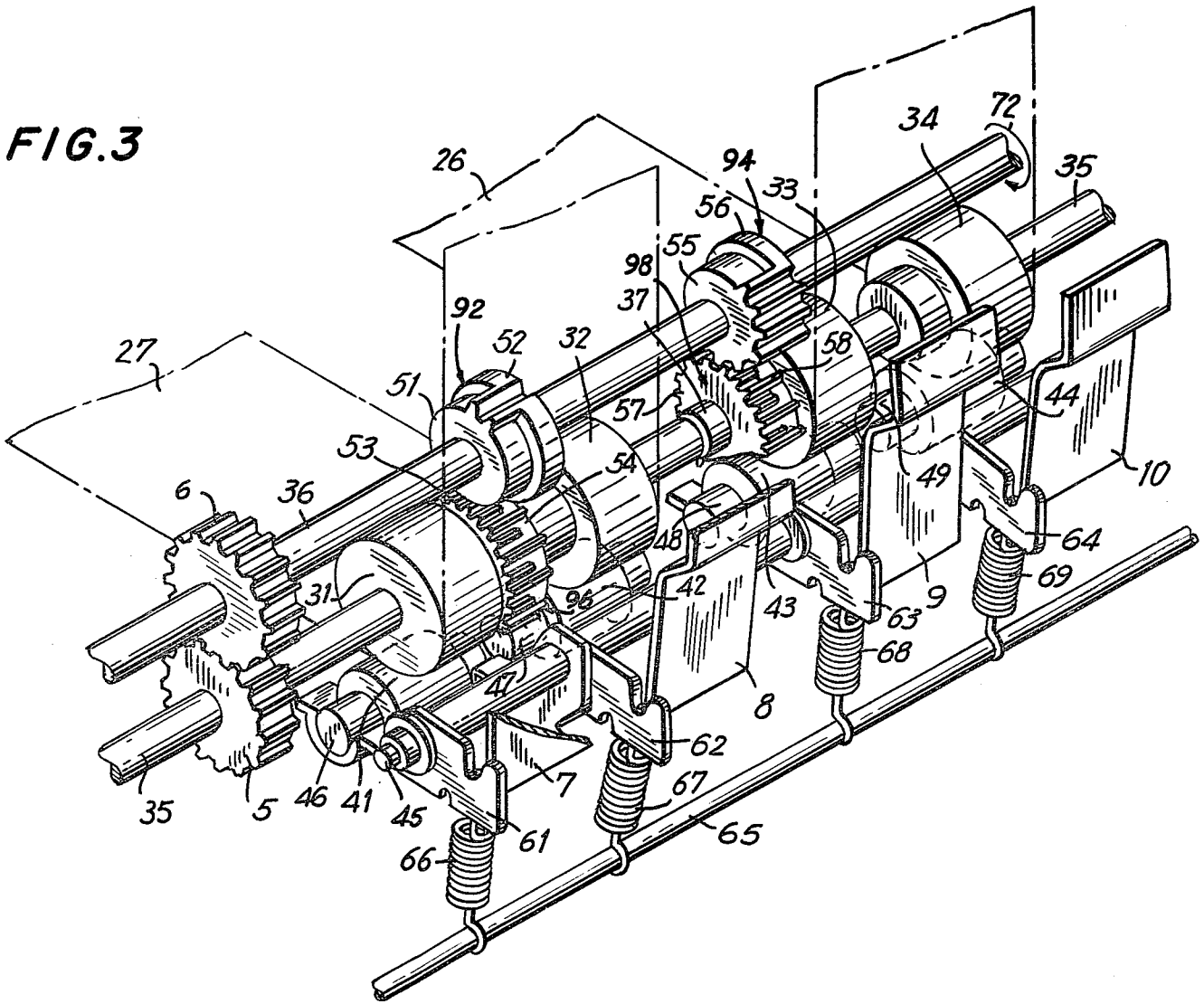
FIG. 3 is a partially cut-away perspective view of the web feeding rollers and associated idler rollers of the web feeding mechanism depicted in FIG. 1, and their respective drive and selection mechanisms.

Accordingly, a driving mechanism for selectively driving the respective feed rollers at a predetermined rotary speed, is provided. Gear 6, as is detailed above, is driven by a series of gears and is mounted to a shaft 36, to thereby effect a complete rotation of shaft 36 for each printing cycle. The manner in which gear 6 effects a single rotation of shaft 36 for each printing cycle is well known in the art. Two pairs of gear wheels 92 and 94 are fixedly mounted to shaft 36 to be rotated thereby. The first pair 92 includes gear wheels 51 and 52 and the second pair includes gear wheels 55 and 56. Gear wheels 51 and 52 and 55 and 56 may be separately constructed, as is illustrated in FIG. 5, or molded together, from any suitable material such as plastic, as is illustrated in FIGS. 1, 3 and 4. The gear wheels 51, 52, 55 and 56 of pairs 92 and 94 are disposed in meshing engagement with gears 53, 54, 57 and 58, respectively, which gears are supported by shaft 35, which shaft also supports paper feeding rollers 31, 32, 33 and 34. It is noted that gear 5, which gear drives gear 6, is also mounted to shaft 35. Gear 5 however is supported by shaft 35 merely for compactness of construction and is rotatably mounted to shaft 35 to be freely rotated with respect thereto and, hence, does not affect the rotation of shaft 35. Gear wheels 51 and 52 of pair 92 are mounted on shaft 36 to drive gear pair 96, which includes gears 53 and 54 supported on shaft 35. Similarly, gear pair 94 on shaft 36 drives gear pair 98, which pair includes gears 57 and 58 mounted on a bearing sleeve 37, which sleeve is rotatably supported on shaft 35.

The cooperative engagement of gear pair 92 with gear pair 96 is best understood by making reference to FIG. 5. Gear wheel 51 is provided with two gear teeth 77 extending from its periphery. Teeth 77 define a recess 79 therebetween. The teeth 77 are adapted to engage the teeth 78 extending from the periphery of gear 53. Gear wheel 52 is formed with a single recess 70 for engagement with one of the teeth 71 extending from the gear 54. Recess 70 is disposed at the same angular position, in gear wheel 52, as the clearance 79 between teeth 77 and gear wheel 51. As shaft 36 rotates in the direction 72, illustrated by the arrow, the periphery of gear 52 will ride in the clearance 101 defined between each tooth 71 on gear 54 to thereby prevent shaft 35 from being rotated by gear wheel 52. When a first tooth 77, on gear wheel 51, engages a tooth 78 on gear 53, recess 70 on gear wheel 52 will approach a tooth 71 on gear 54. Engagement of tooth 78 by tooth 77 will result in shaft 53 rotatably being displaced in an angular direction indicated by arrow 100, which direction corresponds to the direction in which the paper web 37 is displaced. Specifically, the paper web will be displaced by a distance, determined by the angular displacement of the roller and the amount of displacement will equal one line of type for each full rotation of shaft 36 (one print cycle). The driving of gear pair 96 is effected in the following manner: After a first tooth 77 on gear wheel 51 engages a tooth 78 on gear 53, recess 70 on gear wheel 52 engages tooth 71 on gear 54 and thereby continued to rotate shaft 35 until the second tooth 77 on gear wheel 51 clears the teeth 78 on gear 53. After the clearance of teeth 77 of gear 51 with the teeth 78 of gear 53, the periphery of gear wheel 52 will again ride in the clearance 101 defined between the respective gear teeth 71 on gear 54 to thereby prevent gear 54 and, hence, shaft 35 from rotating until the next print cycle begins.

The relationship between gear pair 94 and gear pair 98 is identical to that of gear pair 92 and 96, with the exception that gear pair 94 is provided with more teeth than gear pair 92. Gears 57 and 58, comprising gear pair 98, are similar to gears 53 and 54, comprising gear pair 96. However, gear wheel 55 has eight teeth 102 and gear wheel 56 is provided with seven recesses 104. As the two teeth 77 on gear wheel 51 correspond to an advancement of one line of web 27, the eight teeth 102 on gear wheel 55 correspond to an advancement of 4 lines of web 26. When each of the teeth 102 are out of engagement with gear 57, the abutment of the periphery of gear wheel 56, between the clearance defined between the teeth on gear 58, causes gear pair 98 not to be rotated thereby.

Accordingly, if the gear wheels 51 or 55 are provided with n teeth and the gears 53 or 57 respectively driven thereby are provided with m teeth, the gear wheels 52 or 56 must be provided with $n$-1 grooves. The gears 54 or 58 must then be provided with $m/2$ teeth. Moreover, the driven pair of gears 96 or the driven pair of gears 98 will be rotated through angular displacement of $n/2$ teeth for each line of printing, the number of lines of paper feeding for each printing cycle equalling $n/2$. Accordingly, by selecting the number of teeth on the first gear wheel of the pair of gear wheels, the angular displacement of the feed roller, and hence, the rate at which the paper is fed can be determined. Moreover, the aforedescribed gear driving arrangement insures proper meshing of the gear teeth to thereby reduce the noise that is likely to result from the web feeding operation.

The rotational driving of the various paper feeding rollers is effected in the following manner: Paper feeding roller 31 is rotatably mounted on shaft 35 by means of a bearing sleeve (not shown) so that it is freely rotatable with respect to the rotation of shaft 35. Paper feeding roller 32 is fixedly mounted to shaft 35. Accordingly, paper feeder roller 32 is rotatably driven by shaft 32 and gear pair 96 by the pair of gear wheels 92 and is indexed through a predetermined angular rotation corresponding to a distance equal to one line of type for each printing cycle. Paper feeding roller 33 is coupled for rotation with gear pair 98 and both are rotatably mounted by bearing sleeve 37 on shaft 35 so that the rotation of paper feeding roller 33 and gear pair 98 is independent of the rotation of shaft 35. Paper feeding roller 33 and gear 98 are driven by pair 94 of gear wheels 56 and for each print cycle will be indexed an amount equal to four lines of paper feeding. Paper feeding roller 34 is fixedly mounted to shaft 35 so that the rotation of shaft 35 is imparted by gear pair 96 in an amount equal to a one line feed for each printing cycle which rotation is transmitted to roller 94 for each complete rotation of shaft 35.

Accordingly, the driving mechanism of the instant invention provides for two modes of feeding each paper web 26, 27. When solenoid 17, which controls the feeding mode of paper web 27, is not energized idler roller 42 is disposed in contact with web 27 and paper feeding roller 32 and idler roller 41 is disposed out of engagement with paper web 27 and paper feeding roller 31. Paper web 27 will then be displaced and indexed by paper feeding roller 27 in an amount equal to one line of type for each printing cycle. Conversely, when solenoid 17 is energized idler roller 42 will be disengaged from web 27 and idler roller 41 and paper feeding roller 31 will engage web 27. Since paper feeding roller 31 is freely rotatably mounted to shaft 35 and, hence, is not driven thereby, feeding of web 27 does not occur since rotary motion is not imparted to paper feeding roller 31 either directly or through shaft 35.

Solenoid 18 controls the paper feeding mode for paper web 26. When solenoid 18 is not energized, idler roller 44 is disposed in engagement with web 26 and paper feeding roller 34. Paper feeding roller 34 is fixedly mounted to shaft 35 and will be indexed an amount equal to one line of type for each printing cycle by the rotation of shaft 35 due to gear pair 96, which pair is driven at all times by gear pair 92, regardless of the mode of feeding of paper webs 26 and 27. When solenoid 18 is energized, idler roller 44 is displaced from engagement with web 26 and idler roller 43 engages web 26 and paper feeding roller 33, which roller is freely mounted on shaft 35, thereby resulting in paper feeding roller 33 not being rotatably affected by the rotation of shaft 35. Paper feeding roller 33 is coupled for rotation with gear pair 98 which, in turn, is driven by gear pair 94 and is indexed in an amount corresponding to four type lines per printing cycle.

In summary, a combination of four paper feeding modes are available from the paper feeding mechanism illustrated in FIGS. 1 through 5. If both solenoids 17 and 18 are energized, both paper web 27 and paper web 26 are indexed by an amount equal to one line of type for each printing cycle. When solenoid 17 is energized and solenoid 18 is not energized, paper web 27 is not indexed at all and paper web 26 is indexed by an amount equal to one line of type for each printint cycle. When solenoid 17 is not energized, and solenoid 18 is energized for each print cycle, paper web 17 is indexed by an amount equal to one line and paper web 26 is indexed by an amount equal to four lines of type. The fourth combination occurs when both solenoids 17 and 18 are energized so that paper web 27 is not fed and paper web 26 is fed at a rate equal to four lines of type for each printing cycle.

Additionally, the angular positions of gear pairs 92 and 94 may be arranged so that paper web 26 may be indexed by an amount equal to five lines of type. When solenoid 18 is energized, paper feeding roller 33 and idler roller 43 index web 26. If immediately after the four line displacement of web 26, by the paper feeding roller 33, soleniod 18 is deenergized, web 26 will be displaced an additional amount of one line of type by paper feeding roller 44, thereby making the rate of feed five lines of displacement for each printing cycle.

It is to be noted that gear pairs 92 and 94 have been illustrated above with paper feeding capabilities of one line and four lines, respectively. However, the instant invention is in no way limited to such feed rates but, rather, since the gear pairs 96, 98 driven by gear pairs 92 and 94 are identical, in order to change feed rates it is only necessary to replace gear pairs 92 and 94 with gears having different numbers of teeth and recesses. As is illustrated in FIG. 1, shaft 35 is located near the top of the assembly, and thus is readily replaceable or interchangeable. Furthermore, it is possible to locate shaft 36 and its associated gears completely outside of frame 25. As detailed above, for each n-teeth on gears 51 and 55 of gear pairs 92 and 94 respectively the respective webs of paper 27, 26 will be indexed $n/2$ lines of type for each printing cycle. Also, for each n teeth on gear wheels 51 and 53, there are $n$-1 notches on gears 52 and 56 respectively. Thus, for a two-line feed the driving gear wheel would have four teeth and three notches, a three-line feed six teeth and five notches and a five-line feed, ten teeth and nine notches, etc.

For purposes of explanation, the paper feeding rollers are illustrated in the drawings as being positioned proximate to the edges of the paper webs. However, it is preferred that the paper feeding rollers be as centrally located as possible with regard to the webs of paper. This may be accomplished by merely reversing the position of shaft 35 of certain of the paper feeding rollers depicted in the drawings.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A web feeding mechanism for feeding at least one web comprising first web feeding roller means and second web feeding roller means, each of said web feeding roller means being adapted to engage one side of a web, first idler means and second idler means, said first idler means being adapted to be displaceably positioned between an engaging position on another side of a web at which said first idler means engages the associated web against said first feeding roller means and a non-engaging position wherein said first idler means is disposed out of engagement with the associated web, said second idler means being adapted to be displaceably positioned between an engaging position on another side of a web at which said second idler means engages the associated web against said second feeding roller means and a non-engaging position wherein said second idler means is out of engagement with the associated web, first drive gear means coupled to said first web feeding roller means for driving said first web feeding roller means to advance the associated web at a first predetermined rate when said first idler means is disposed in said engaging position, second drive gear means coupled to said second web feeding roller means for driving said second web feeding roller means to advance the associated web at a second predetermined rate when said second idler means is displaced in said engaging position, each of said first and second drive gear means comprising a first driving gear having n teeth, a first driven gear having m teeth cooperatively engageable with said first driving gear, a second driving gear having n-1 notches disposed in the periphery thereof and mounted for rotation with said first driving gear, a second driven gear having m/2 teeth and mounted for rotation with said first driven gear, said n-1 notches in said second driving gear engaging said m/2 teeth on said second driven gear when said n teeth on said first driving gear are in engagement with said m teeth of said first driven wheel, each said second driving gears including a peripheral region outside of the region of said $n$-1 notches for abutting intermediate two of said $m/2$ teeth on said second driven gear for preventing said second driven gear from rotating when said $n$ teeth of said first driving gear are out of engagement with said m teeth of said first driven gear, and idler displacement means for selectively displacing said first and second idler means between their respective engaging positions and non-engaging positions.

2. A web feeding mechanism as claimed in claim 1, wherein said idler displacement means for said first and second idler means includes first and second support members, each said first and second support member having a first end to which said first and second idler means are respectively mounted, solenoid means including a displaceable selection member abutting the other end of each of said first and second support members for displacement thereof, said selection member and said first and second support members being constructed and arranged so that said other end of said first support member is abuttingly engaged by said selection member when said other end of said second support member is disengaged from said idler roller selection member, said selection member being adapted to abuttingly engage the other end of said second idler means support member when said other end of said idler means support member is disengaged from said idler roller selection member.

3. A web feeding mechanism as claimed in claim 2, wherein said first and second support members include biasing means for normally biasing the respective idler roller means into engagement with said respective first and second feeding means in the absence of said selecting member being disposed in abutting engagement with the other end of said support member.

4. A web feeding mechanism as claimed in claim 2, wherein said solenoid means includes projection means for biasing said idler selection member into abutting engagement with said first support member and out of engagement with said second support member.

5. A web feeding mechanism as claimed in claim 1, and further including a third web feeding roller means, said third web feeding roller means being adapted to engage the same web as said first web feeding roller means, third idler means, said third idler means being displaceable between an engaging position at which said third idler means engages said web associated with said third feeding roller means against said third roller means and a non-engaging position wherein said third idler means is disposed out of engagement with said associated web, and third drive means coupling said third web feeding roller means to said second drive gear means to advance the associated web at said second predetermined rate when said third idler means is disposed in said engaging position, said idler displacement means selectively displacing said third idler means between its engaging position and said non-engaging positions.

6. A web feeding mechanism as claimed in claim 1, wherein said first web feeding roller means and said first idler means are adapted to engage the same web as said second web feeding roller means and second idler means.

7. A web feeding mechanism as claimed in claim 6, wherein said idler displacement means is constructed and arranged to alternately dispose said first and second idler means in said engaging position.

8. A web feeding mechanism as claim in claim 1, wherein said first web feeding roller means and said second web feeding roller means are adapted to engage different webs, and said first and second drive gear means are adapted to drive said first and second web feeding roller means at different rates.

9. A web feeding mechanism as claimed in claim 1, including means for coordinately driving said first and second driving gears of said first and second drive gear means.

10. A web feeding mechanism as claimed in claim 9, including shaft means fixedly supporting said first and second driven gears of said first drive means and said first web feeding roller means for rotation therewith and sleeve means mounted for rotation relative to and about said shaft means and fixedly supporting said first and second driven gears of said second drive means and said second web feeding roller means for rotation therewith.

11. A web feeding mechanism as claimed in claim 1, wherein the number n of teeth on the first driving gear of said first drive gear means is different from the number of teeth n of the first driving gear of said second drive gear means, whereby each of said first and second web feeding roller means incrementally advances the web associated therewith when said web is engaged thereagainst by said first and second idler means respectively by a distance dependent upon the number of teeth on the respective first driving gear.

12. A web feeding mechanism for feeding at least one web comprising first web feeding means and second web feeding means, each of said web feeding means being adapted to engage one first side of a web, first idler means and second idler means, said first idler means being adapted to be displaceably positioned between and engaging position on another side of a web at which said first idler means engages the associated web against said first feeding means and a non-engaging position wherein said first idler means is disposed out of engagement with the associated web, said second idler means being adapted to be displaceably positioned between an engaging position on another side of a web at which said second idler means engages the associated web against said second feeding means and a non-engaging position wherein said second idler means is out of engagement with the associated web, first drive means coupled to said first web feeding means for driving said first web feeding means to advance the associated web at a predetermined rate when said first idler means is disposed in said engaging position, first and second idler displacement means for selectively respectively displacing said first and second idler means between their respective engaging and non-engaging positions, each idler displacement means including abutment means, and idler selection means including a displacement member adapted to be displaced between a first and second position, said displaceable member having first and second camming means, said first camming means being adapted to engage said abutment means of said first idler displacement means when said displacement member is disposed in a first position but not in a second position, said second camming means being adapted to engage said abutment means of said second idler displacement means when said displaceable member is disposed in said second position but not in said first position so that said respective first and second idler displacement means are alternately actuated in response to said idler selection means for the selective driving of the web by one of said first and second web feeding means.

13. A web feeding mechanism as claimed in claim 12, and including a spring biasing means coupled to each idler displacement means for biasing said idler displacement means into said actuated engaging position in the absence of said abutment means being in abutment with said camming means.

14. A web feeding mechanism as claimed in claim 12, including second drive means coupled to said second web feeding means for driving said second web feeding means to advance the associated web at a second predetermined rate when said second idler means is displaced in its engaging position, whereby said first and second idler displacement means are alternately actuated in response to said idler selection means for the selective driving of the web at one of said first-mentioned and second predetermined rates.

15. A web feeding mechanism for feeding at least one web comprising first, second and third web feeding roller means, said first and second web feeding roller means being adapted to engage one side of a first web, said third web feeding roller means being adapted to engage one side of a second web, first idler means adapted to be displaceably positioned between an engaging position on another side of said first web at which said first idler means engages said first web against said first web feeding roller means and a non-engaging position wherein said first idler means is disposed out of engaging relation with said first web feeding roller means, second idler means adapted to be displaceably positioned between an engaging position on another side of said first web at which said second idler means engages said first web against said second web feeding roller means and a non-engaging position wherein said second idler means is disposed out of such engaging relation with said second web feeding roller means, third idler means adapted to be displaceably positioned between an engaging position on another side of said second web at which said third idler means engages said second web against said third web feeding roller means and a non-engaging position wherein said third idler means is disposed out of such engaging relation with said third web feeding roller means, first drive gear means coupled to said first and third web feeding means for driving said first and third web feeding means to advance the associated web at a first predetermined rate when said first or third idler means is disposed in its engaging position, second drive gear means coupled to said second web feeding roller means for driving said second web feeding roller means to advance said second web at a second predetermined rate when said second idler means is disposed in its engaging position, and idler displacement means for selectively displacing each of said first, second and third idler means between its respective engaging and non-engaging positions, each of said first and second drive gear means including driving gear means and driven gear means, said driving gear means of said first and second drive gear means being mounted for coordinate displacement, said driven gear means of said first and second drive gear means being independently rotatable, said driven gear means of said first drive means being coupled to said first and third web feeding roller means for rotation thereof, said driven gear means of said second drive gear means being coupled to said second web feeding roller means for rotation thereof.

16. A web feeding mechanism as recited in claim 15, wherein said each of said driving gear means includes a first driving gear having n teeth and a second driving gear having $n$-1 notches disposed in the periphery thereof, each of said driven gears including a first driven gear engaged with said first driving gear and a second driven gear engaged with said second driving gear, said first and second driven gears being constructed and arranged so that said first and second webs may be selectively displaced a distance determined by the number n of teeth on each of said first driving gears for each complete rotation of said driving gears.

17. A web feeding mechanism as claimed in claim 16, wherein said each of said first driven gears has m teeth and each of said second driven gears has $m/2$ teeth, said $n$-1 notches in each of said second driving gears engaging said $m/2$ teeth on the associated second driven gear when said n teeth on the associated first driving gear are in engagement with said m teeth of said first driven gear, each said second driving gears including a peripheral region outside of the region of said $n$-1 notches abutting intermediate two of said $m/2$ teeth on said second driven gear for preventing said second driven gear from rotating when said $n$ teeth of said first driving gear are out of engagement with said $m$ teeth of said first driven gear.

18. A web feeding mechanism as recited in claim 15, including shaft means for supporting for rotation therewith said driven gear means of said first drive gear means and said first and third web feeding roller means for rotation therewith, and sleeve means mounted for rotation about and independent of said shaft means and supporting said driven gear means of said second drive gear means and said second web feeding roller means.

19. A web feeding mechanism as claimed in claim 15, wherein said idler displacement means includes selecting means for alternately disposing said first and second idler means in their respective engaging positions.

* * * * *